United States Patent [19]

Virtanen

[11] 4,126,655

[45] Nov. 21, 1978

[54] METHOD AND APPARATUS FOR MANUFACTURING CONCRETE ELEMENTS

[76] Inventor: Pentti E. E. Virtanen, Ilvestie 6, 37800 Toijala, Finland

[21] Appl. No.: 689,365

[22] Filed: May 24, 1976

[30] Foreign Application Priority Data

Jun. 10, 1975 [FI] Finland ..... 751732

[51] Int. Cl.[2] ..... B28B 1/08

[52] U.S. Cl. ..... 264/71; 264/310; 264/333; 264/336

[58] Field of Search ..... 264/71, 87, 333, 334, 264/310, 336

[56] References Cited

U.S. PATENT DOCUMENTS

| | | | |
|---|---|---|---|
| 2,655,710 | 10/1953 | Roensch | 264/87 |
| 3,492,384 | 1/1970 | Matthews | 264/71 |

*Primary Examiner*—Thomas P. Pavelko

[57] ABSTRACT

A method and mould for manufacturing concrete elements by means of a turnable mould, whereby the concrete is cast in a main mould when the latter is in horizontal position while the mould is at the same time vibrated. The mould has a closed construction and is used in such a way that, at the casting stage, the second half of the mould construction, which is hinged in relation to the main mold, is in vertical position. Thereafter the mould construction is closed which causes a pressure on the concrete, whereby any excess concrete is extruded through the slit between the mould halves. Then the entire mould construction is turned into vertical position while continuing the vibration so as to eliminate any air that has moved to the outer surfaces of the element. The mould construction is turned further by 90° so that said second half of the mould, which comprises a frame and an auxiliary mould fastened inside the frame, remains underneath. Finally the main mould is lifted into vertical position and the auxiliary mould is detached from the frame so as to shift the element away.

3 Claims, 9 Drawing Figures

METHOD AND APPARATUS FOR MANUFACTURING CONCRETE ELEMENTS

Figure 1:
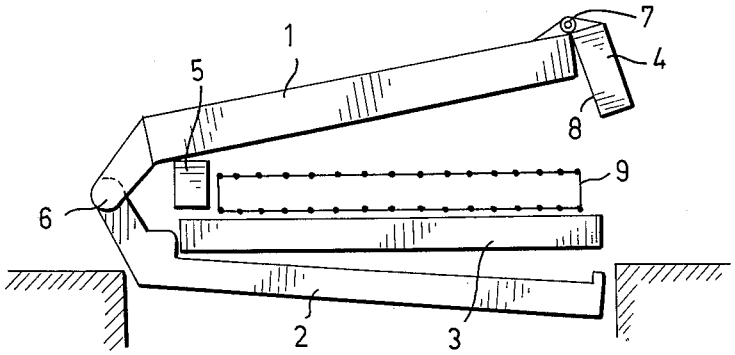

The present invention relates to a method for manufacturing concrete elements by means of a turnable mould of a closed construction, said mould comprising a first mould half, a second mould half which is hinged to the first mould half, an auxiliary mould to be detachably arranged between the first and the second mould half, and vibration devices, whereby the casting is performed while the turnable mould is in an at least approximately horizontal casting position so that the mix to be cast is compressed in the space between the first mould half and the auxiliary mould, the turnable mould is turned into an at least approximately vertical vibrating position, whereupon the turnable mould is turned into an at least approximately horizontal disassembly position, in which it is opened, and the element is removed as lying on the auxiliary mould from between the first and the second mould half for further treatment.

The invention also relates to a turnable mould for carrying out the method.

When concrete elements are manufactured, there is at present a tendency to use ever more viscous mixes, because by using such mixes it has been possible to increase the strength of the element, to use less cement, and to shorten the casting time. From the point of view of the strength of the concrete, it is important that the air in the concrete mix can be removed as completely as possible. Removal of this air has been attempted by means of vibration, but in the case of highly viscous mixes, vibration alone is not sufficient to pack the concrete mix enough.

The purpose of the present invention is to eliminate the drawback mentioned above and to provide a casting method and apparatus in which, when starting from highly viscous mixes it is possible to manufacture ever stronger concrete elements by means of efficient packing. This invention is based on the idea that, in addition to vibration, the concrete mix to be cast is compressed and the entire mould is turned into different positions so as to eliminate the air, and the finished elements are moved away constantly by using a movable auxiliary mould arranged in the mould construction.

The method in accordance with the invention is mainly characterized in that when the concrete mix is being cast, the first mould half functions as the casting base proper, the auxiliary mould being fastened to the inner surface of the second mould half, which is at least partly opened, and the turning of the turnable mould from the vertical position to the disassembly position is performed in the same direction as the turning from the casting position to the vertical position, i.e., the turnable mould performs a turning of at least approximately 180° when moving from the casting position to the disassembly position.

Particular embodiments of the method in accordance with the invention are defined in claims 2 and 3.

The turnable mould in accordance with the invention is mainly characterized in that the first mould half is arranged as the casting base proper, at the same time as the auxiliary mould is arranged to be detachably fastened to the inner surface of the second mould half, and the turning mechanism is arranged to turn both mould halves on the hinge devices either together or separately, by at least approximately 180°.

By means of the invention, considerable advantages are obtained. So, by the method in accordance with the invention, it is possible to use highly viscous mixes in the manufacture of concrete elements. As the mould is completely closed, the cast element becomes a duplicate of the mould with precise dimensions. By means of the new method, higher strenghts are obtained for the concrete than by casting in an open mould. The element can be disassembled from the mould immediately after casting. The method permits automatic manufacturing of elements. As the casting itself takes place at a stationary position and highly automatically, the casting site can be noise-insulated easily. The method is suitable for the manufacturing of almost all concrete elements to-day produced, such as various beams, columns, solid slabs, hollow slabs, so-called TT-slabs, and ribbed slabs.

The invention will be examined in more detail below, reference being made to the embodiment in accordance with the attached drawings.

FIGS. 1 to 9 show the method and turnable mould in accordance with the invention at different steps as cross-sectional views and as applied to the manufacturing of a hollow slab.

The mould construction in accordance with the drawing comprises a main mould (first mould half) 1 and a frame (second mould half) 2, which are at one end 6 hinged so as to constitute the main components of the mould construction. At each end of the main mould 1 are placed side members 4 and 5 of the mould, the former of which is by a hinge device 7 connected to the outer end of the main mould 1. The mould construction comprises further side constructions not shown in the drawing, which, when the mould construction is being closed, function as two opposite side walls of the mould.

In the situation shown in FIG. 1, the mould construction is in an approximately horizontal position, the frame 2 being in a slightly lowered and the main mould 1 in a slightly raised position. Onto the frame 2 has been introduced an auxiliary mould 3 which can be arranged on the inner surface of the frame 2. When the auxiliary mould 3 is introduced into the mould, a reinforcing framework 9 is already placed on same. In the direction of the hinge axis 6 of the mould construction, there are rods or tubes 10 (FIG. 2) for the forming of the cavities in the element to be manufactured, which rods or tubes can, at a later stage of the process, be pushed through the reinforcement framework 9.

Figure 2:
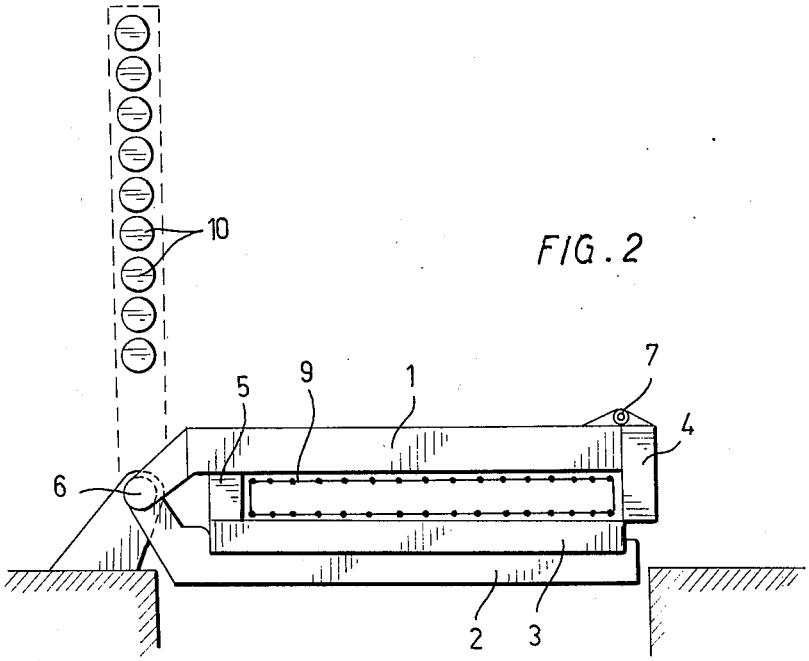
Figure 3:
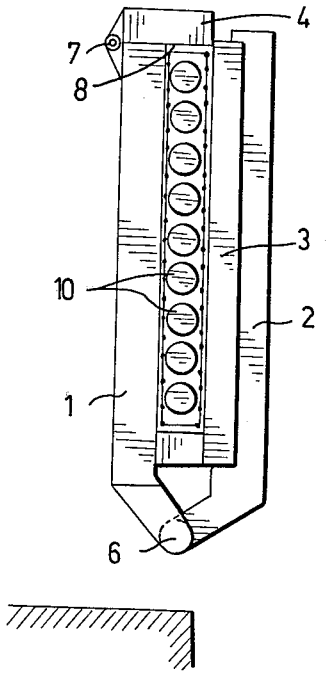
Figure 4:
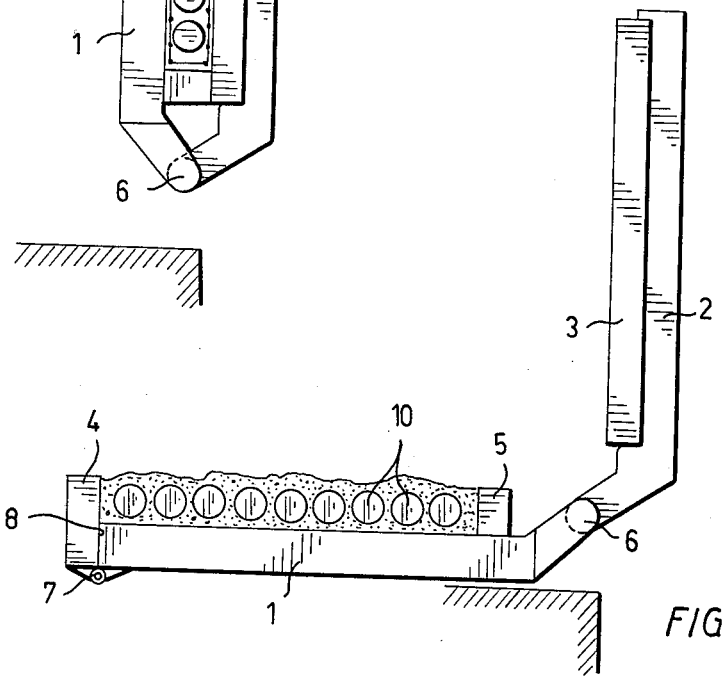
Figure 5:
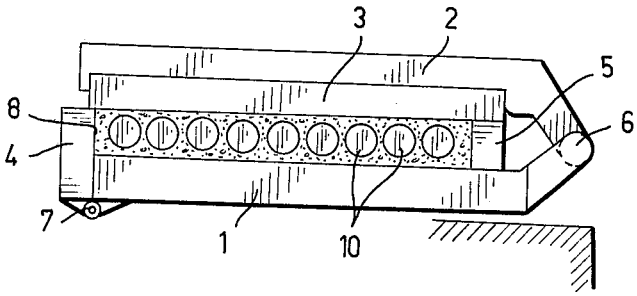
Figure 6:
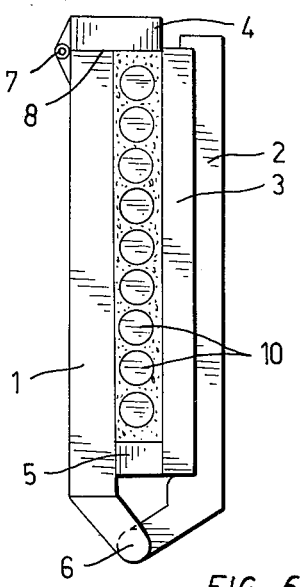
Figure 7:
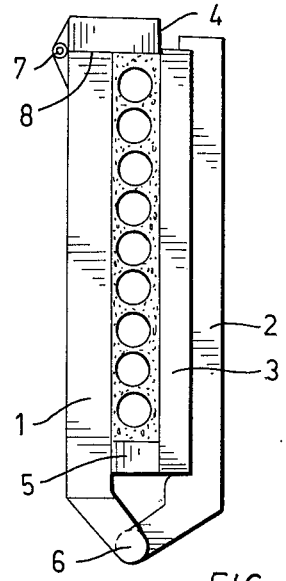
Figure 8:
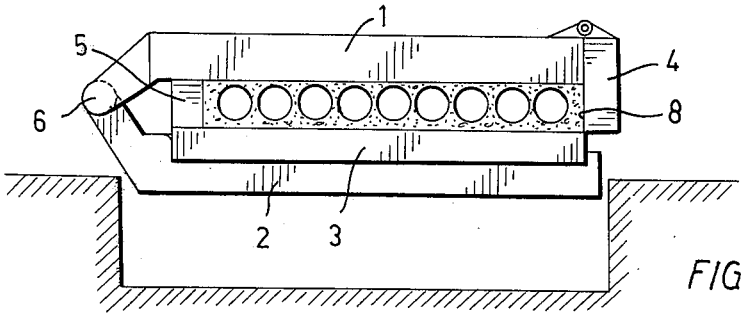
Figure 9:
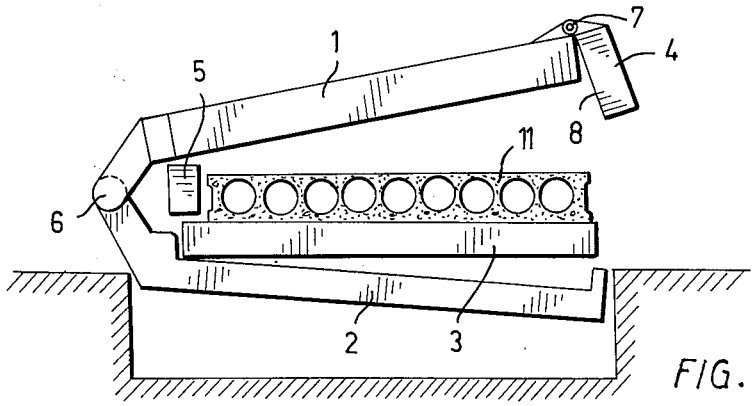

In FIG. 2, the main mould 1 together with the end members 4 and 5 is closed around the auxiliary mould 3 (and the reinforcement framework on same).

At the next stage (FIG. 3) the entire mould construction is turned 90° into vertical position and the rods or tubes 10 mentioned above are pushed through the reinforcement framework 9 from the side.

It should be mentioned that, for these rods or tubes 10, the lateral constructions 12 of the mould are provided with holes 13 (FIG. 2) intended for them, through which holes they can be pushed in and removed.

In the following step (FIG. 4), the frame 2 and the auxiliary mould 3 fastened to its inner surface remain in vertical position but the main mould 1 is turned further by 90° so that it comes into horizontal position. It has also been followed by the reinforcement framework 9 and by the rods or tubes 10 pushed through same. At this stage, the casting proper of the concrete mix is performed so that the thickness of the concrete bed is somewhat higher than the thickness of the final element.

In the next step (FIG. 5), the frame 2 and the auxiliary mould 3 are turned likewisely 90° onto the cast concrete bed, whereby a compression force acts on this bed, of the order of 0.01 MN per square meter. At the same time with the casting, the mould construction is vibrated efficiently so as to remove the air from the concrete mix. Due to the effect of said conpression force, the concrete is packed further and any excess material is extruded through the slit between the auxiliary mould 3 and the lateral member 4 of the main mould. At this stage, as a result of the effect of the vibration and compression, air has been accumulated on the surface facing the concrete of the auxiliary mould 3.

In order to eliminate this air, the entire mould construction is again raised into vertical position (FIG. 6) while the vibration is still continued. At this stage, due to the effect of the removal of the air and of further packing of the concrete, the upper edge of the element now reaches its final shape, and this little change in the volume has been taken into account in the construction of the lateral beam 4, whose inner surface 8 can be pressed against the side of the element by means of a device not shown.

In the next step (FIG. 7), the rods or tubes 10 arranged inside the element for the purpose of forming the cavities can be pulled off.

At this stage the element is in principle already finished, but for the removal of the element, the entire mould is turned into horizontal position with the frame 2 underneath (FIG. 8) whereupon the mould construction is opened (FIG. 9) by lifting the main mould 1 upwards. By opening the sides and detaching the auxiliary mould 3 from the inner surface of the frame 2, the element 11 is, on the movable auxiliary mould 3, moved out of the mould construction for heat treatment. At this stage the mould construction is ready to receive a new auxiliary mould 3 with reinforcement framework 9 for repetition of the process (of FIG. 1).

The drawings do not show the turning mechanism of the mould, which is of a type known per se. The turning mechanism may be, for example, a combination of hydraulic torsion motors or torsion cylinders or equivalent. The rods or tubes 10 can be pushed into their positions by using various methods, for example by means of hydraulic cylinders. As vibration, it is possible to use conventional high-frequency vibration, but a combination of high-frequency vibration and low-frequency vibration has proved highly advantageous.

In the exemplifyling embodiment presented above it has been assumed that the element is provided with a reinforcement framework and cavities, but these are of course not essential for the invention nor necessary. If, for example, an unreinforced solid element is manufactured, the steps 1 to 3 and 7 of the exemplifying embodiment shown above are not required at all, but the process can be started from the situation indicated in FIG. 4. The way in which the auxiliary mould 3 is introduced into the mould construction and fastened to the inner surface of the frame 2 may of course vary as required. Thus, the bottom of the auxiliary mould 3 may be provided with wheels on which it can be pushed onto the frame, or, alternatively, the inner surface of the frame 2 may be provided with wheels on which the auxiliary mould 3 can move. The auxiliary mould 3 can be fastened to the inner surface of the frame 2, for example, by means of a mechanical locking device.

What I claim is:

1. A method for manufacturing concrete elements by means of such a turnable mould of a closed construction, said mould comprising:

a first mould half;

a second mould half which is hinged to the first mould half;

an auxiliary mould to be detachably arranged between the first and the second mould half; and vibration devices, the method comprising the following steps:

the casting is performed while the turnable mould is in an at least approximately horizontal casting position so that the mix to be cast is compressed in the space between the first mould half and the auxiliary mould, such that the first mould half functions as the casting base proper, the auxiliary mould being fastened to the inner surface of the second mould half, which is at least partly opened.

the concrete in the mould being subjectd simultaneously to vibration and compression, the turnable mould is turned into an at least approximately vertical vibrating position, whereupon the turnable mould is turned into an at least approximately horizontal disassembly position, in which it is opened, using the auxiliary mold as a transport means for removing the cast element from the mould the turning of the turnable mould from the vertical position to the disassembly position being performed in the same direction as the turning from the casting position to the vertical position, such that, the turnable mould performs a turning of at least approximately 180° when moving from the casting position to the disassembly position.

2. A method as claimed in claim 1, wherein a reinforcement framework required by the element is placed on the first mould half before casting.

3. A method as claimed in claim 1, for the production of hollow slabs, wherein profile robs or tubes are placed in the turnable mould before casting.

* * * * *